United States Patent [19]

Noto

[11] 4,361,393

[45] Nov. 30, 1982

[54] VERY HIGH SPEED DUPLICATOR WITH FINISHING FUNCTION

[75] Inventor: Fedele A. Noto, Williamson, N.Y.

[73] Assignee: Xerox Corporation, Stamford, Conn.

[21] Appl. No.: 254,354

[22] Filed: Apr. 15, 1981

[51] Int. Cl.[3] ..... G03G 15/00

[52] U.S. Cl. ..... 355/3 SH; 271/287; 271/294; 270/58

[58] Field of Search ..... 355/3 SH, 14 SH, 14 C; 270/58; 271/287, 290, 288, 294, 296, 297; 414/52, 43

[56] References Cited

U.S. PATENT DOCUMENTS

| | | | |
|---|---|---|---|
| 3,995,748 | 12/1976 | Looney | 271/294 X |
| 4,134,672 | 1/1979 | Burlew et al. | 355/14 |
| 4,248,525 | 2/1981 | Sterrett | 355/14 |
| 4,295,733 | 10/1981 | Janssen et al. | 355/3 SH |

OTHER PUBLICATIONS

IBM Technical Disclosure Bulletin, vol. 18, No. 9, Feb. 1976, p. 2807.

IBM Technical Disclosure Bulletin, vol. 18, No. 10, Mar. 1976, pp. 3160–3161.

*Primary Examiner*—Richard L. Moses

*Attorney, Agent, or Firm*—Bernard A. Chiama

[57] ABSTRACT

A collation/finishing system is disclosed for use with a very high speed, fully automated reproduction machine having a document handling apparatus, copy sheet processor, and a finishing station. In this arrangement, a sorter bin array is arranged to receive copy sheets on one side and to collate the copy sheets into copy sets corresponding to a multiple page document. A pivotal set transport is arranged to unload completed copy sets on the same side whereat loading takes place. The bin array is indexed in either direction to receive copy sheets during loading or to permit unloading.

2 Claims, 7 Drawing Figures

M-3
135
SR-2
91
136
93
101
115
114
SR-L
116
137
113
112
109
SR-1
117
100
110
M-1
M-2

15
14
13
12
11
10
9
8
7
6
5
4
3
2
1
96
95
91
1
92

15
14
13
12
11
10
9
8
7
6
5
4
3
2
1
96
1

13
12
11
10
9
8
7
6
5
4
3
2
1
96
2
3

12
11
10
9
8
7
6
5
4
3
2
1
96
2
3
113
112

PROGRAMER LOGIC AND MICROPROCESSOR
PROCESSOR
XEROGRAPHIC PROCESSING
SHEET FEED
INPUT STATION
FLASH ILLUMINATION
ADH
SWITCHES AND SENSORS S-1, SR-1 SR-2
DRIVER
ELEVATOR DRIVE M-2
FINISHING STATION
SERVO CONTROL
BIN SPACING M-3
POWER AMP
STAPLER DRIVE
STAPLER CLAMPING
STAPLER CLINCHING
SET TRANSPORT DRIVE
INDEX MOTOR M-1

VERY HIGH SPEED DUPLICATOR WITH FINISHING FUNCTION

This invention relates to an improved finishing station for use with a reproduction system.

With the advent of higher speed and more sophisticated copy producing machines, printing presses, and the like, considerations as to how the mass of copies generated can best and most effectively be handled, has assumed increasing importance. One way has been to provide a reproduction system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced. The set of document sheets is then recycled for the reproduction of a second copy set, and so on. After each copy set is produced and collected at a collection station, a finishing device such as a stitcher is activated to bind the set.

These systems are of the pre-collation type wherein the document sheets are precollated in the document handling apparatus prior to commencement of a reproduction run. The output for the reproduction machine will likewise be precollated in sets corresponding to the sequenced numbered document set in the document handling apparatus. The copy sheets are collected in collated sets as they are sequentially produced so that binding may be effected without the interaction of additional devices. Such systems are described in U.S. Pat. No. 4,134,672.

One of the disadvantages in these systems having continuous document recirculation to produce each bound copy set is that for compilation of each copy set and eventual stapling or stitching, many moving parts have been required and have added to the risks of unscheduled maintenance. In addition, generally, in providing for the stapling or stitching step, a varied number of machine pitches per set may be lost thereby reducing productivity for the system.

In order to achieve still higher rates of production of finished copy sets, the present invention contemplates the concept of utilizing post-collation rather than precollation. The inventive arrangement utilizes document handling wherein a predetermined number of light images are produced for each document sheet, say for example, of page one of a multi-page document, before a successive document sheet, perhaps page two of the document, is likewise imaged. This sequencing in turn may be repeated many more times if a very large number of copy sets are to be reproduced. In this manner, the mechanical movements involved in document handling are held to a minimum. As the copy sheets are being produced in accordance with the above imaging procedure, a single array of collecting bins or sorter is indexed vertically in either direction to receive the copy sheet output for collating the same into complete sets by means of a fixed sheet transport arranged to deliver sheets to a fixed loading position. This transport is positioned to load copy sheets on one side of the array of bins.

As the array is being indexed, each completed set is removed from a bin sequentially by means of a set transport positioned on the side of the array as that of the sheet transport to permit loading and unloading on this side. The set transport includes a finishing device such as a stitcher or stapler is positioned adjacent the set transport and activated to apply one or more staples to each completed set.

This arrangement is different than that disclosed in U.S. patent application Ser. No. 180,184, filed Aug. 21, 1980, and commonly assigned in that the present invention utilizes a pivotal set transport arranged to grip a copy set from each bin as the array is indexed and to carry the copy set to a stapler for finishing and upon de-activation directly to a collecting elevator. The combination of a sorter for collating copy sets and a set transport arranged for pivoting movement between an unloading station and a stapler head provides an arrangement capable of very high speed production. In addition, this combination involves a minimum of moving parts, simplicity, less down time and unlimited finishing capability. With the present arrangement, maximum throughput is available from the various apparatus utilized in the reproduction system since the array is indexed for successive bins whereat in the earlier filed, above referred to application, every other bin is unloaded.

The present arrangement is similar to that disclosed in U.S. patent applications Ser. Nos. 254,343, and 254,344, filed concurrently herewith. In the former application, a set transport is utilized on the same side of the sorter array as loading of copy sheets is provided, however, a horizontally, rectilinear moving set transport is utilized which can be cumbersome and relatively slow for high speed production. The latter cited application has its sheet loading and set unloading points on opposite sides of the array of bins thus requiring additional space and areas wherein jams may occur. The present effort is accomplished with a minimum of moving parts, less wear and tear, less down time or maintenance for the apparatus utilized. In addition, the present arrangement offers a more economical system lens spatial requirements and is easily accessible for jam clearance since sorter indexing noise is lower and there is lower power requirements.

PRIOR ART

In the IBM Technical Bulletin, Vol. 18, No. 9, September 1976, page 2607, a collator-stapler apparatus is disclosed having a stationary array of angularly-disposed bins which are loaded on one side and arranged for unloading on the other side. Unloading is accomplished by opening gates associated with the bins and permitting the sets to fall by way of a chute to a stapler station.

In the IBM Technical Disclosure Bulletin, Vol. 18, No. 10, March 1976, pages 3160–3161, a collator-stapler mechanism is disclosed as having a single array of collating bins which are held in fixed position while a traveling clamp moves along to pick up a copy set from each bin and to convey the same to a jogger and then a stapler.

U.S. Pat. No. 4,248,525, illustrates and describes a copy system having a document handler 12, a copy processor, copy storage section 14, and a finisher 16. Ordinarily, the section 14 functions in the manner of a stacking device wherein each bin collects all of the copies of a document sheet either manually or in combination with the handler 12 and is not utilized as a collator. However, the system can be programmed so that the section 14 functions as a conventional collator.

There is no provision for coordinating or integrating this function with that of a finisher to arrive at high speed continuous collating and finishing.

Present day machines on the market, such as the Xerox duplication machines labeled the 9400 Duplicator and the 9500 Duplicator marketed by Xerox Corporation of Stamford, Conn., utilize a document handler as an input device which exposes as many copies of a single document sheet at a time as is appropriate before starting on the next document sheet. Any other suitable type of automatic document handler may also be used in conjunction with the processor for the 9400 or 9500 Duplicators.

It is therefore the principal object of the present invention to produce bound sets or stacks of copies of a multi-page document at the highest speed possible for a reproduction machine.

It is a further object of the present invention to maintain full productivity in a reproduction/finishing system by eliminating those machine copy cycle pitches which are wasted during some machine operating steps.

It is another object of the present invention to minimize the number of moving parts in a finishing station and to reduce the number of movements usually incurred during the operation thereof.

The present invention is directed to a finishing apparatus for binding copy sheets received in succession at a sheet collecting device, comprising a single bin array, having a series of individual vertically arranged inclined bins each with an inlet on one side of the array for receiving individual sheets from a sheet transport which conveys each sheet to the bins in succession and at a fixed loading position. Means are provided for indexing the array in a vertical direction for the sequential loading of copy sheets and the unloading of completed copy sets at an unloading position located vertically below the loading position located vertically below the loading position. A pivotal set transport means is also provided for removing each set of collected copy sets from the bins at the unloading position on the same side of the bin array from the sheet receiving loading position. While the array is being moved vertically for unloading, it is adapted to receive the last sheet of the sets being produced or the first sheets of another block of copy sets to-be-produced. Stapling means for binding each set after removal from the sorter array is arranged to receive each set from the set transport.

While the invention is disclosed in combination with a reproduction machine of the electrostatographic type, it will be understood that the disclosed collating system may be combined with other printing apparatus or machines which merely sort, collect and/or effect the movement of informational items such as sheets or cards.

Other objects and advantages will be apparent from the ensuing description and drawings wherein.

Figure 1:
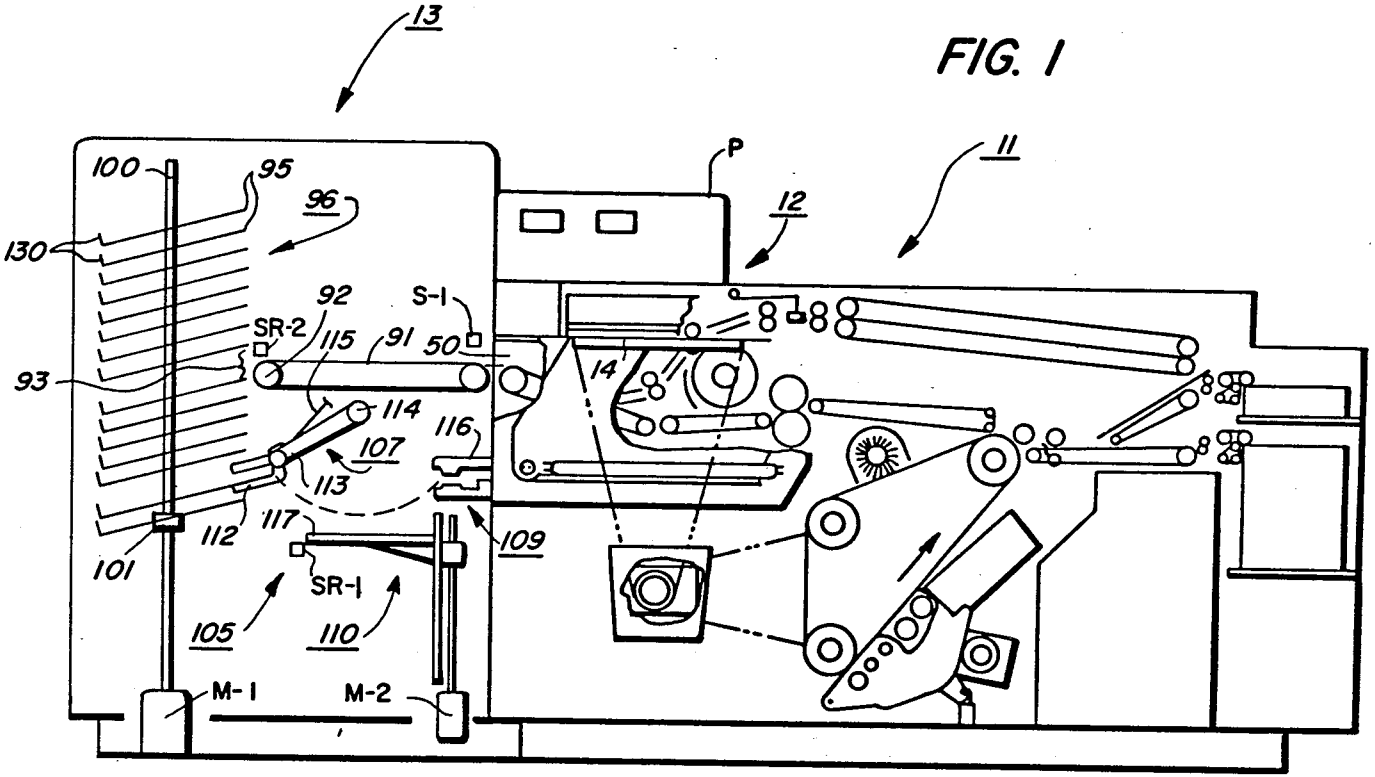
FIG. 1 is a schematic illustration of a configuration of an electrostatographic printing/finishing system employing the present invention.
Figure 4:
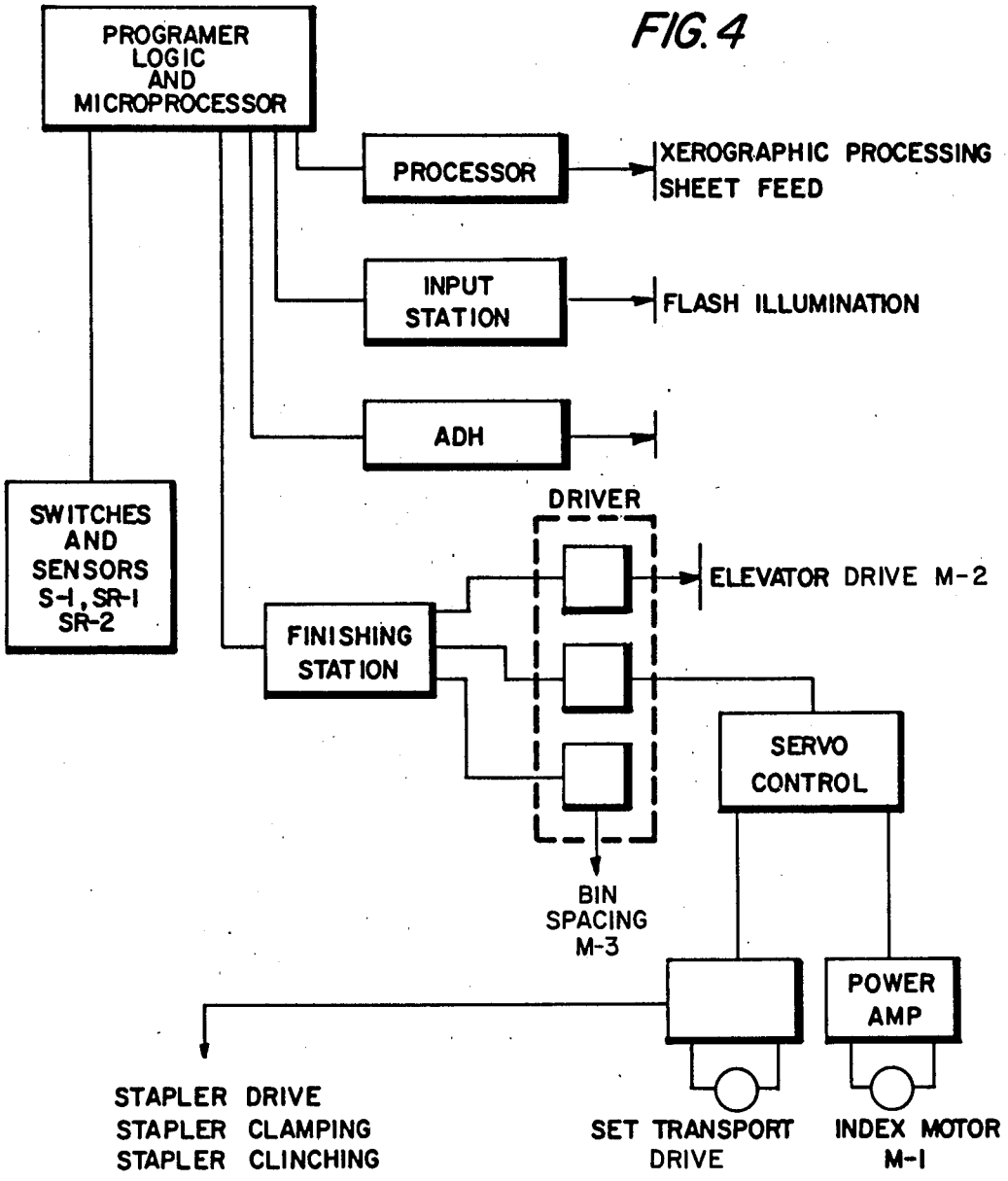

FIGS. 3(*a*) to 3(*d*) illustrate a sequence of events in the finishing of sets of copy sheets; and FIG. 4 is a block diagram of the control scheme for the printing system of FIG. 1.

For a general understanding of a reproduction machine with which the present invention may be incorporated, reference is made to FIG. 1 wherein components of a typical electrostatic printing system are illustrated. The printing system is preferably of the xerographic type as one including a xerographic processor 11, and an automatic type document handling apparatus 12. Preferably, the processor 11 is the same as the processor in the commercial embodiment of the Xerox 9400 Duplicator, which utilizes flash, full frame exposure for very high speed production. Document sheet exposure, image processing and copy sheet transport/handling are under control by a machine programmer and are effected in timed sequence, and in accordance with the program an operator has preset in the machine. Further details in this regard are not necessary since the Xerox 9400 Duplicator operates in this manner and is well known. Details of the timing relationships, the programmer, and related structure and events are described in U.S. Pat. Nos. 3,790,270; 3,796,486; and 3,917,396, commonly assigned and which are incorporated by reference. It will be understood that most any other type of xerographic processor and document handling apparatus may be utilized. Operating in conjunction with the processor 11 and apparatus 12 is a finishing station 13 and thereby forms the reproduction system shown in FIG. 1.

The system comprising the processor 11, the document handling apparatus 12, and the finishing station 13, is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the microprocessor is one similar to the Intel 8080 Microprocessor manufactured by the Intel Corporation, Santa Clara, Calf., and having sufficient ROM's and RAM's for all of the necessary functions in the reproduction system.

The document handling apparatus 12 serves to feed one document sheet D at a time from a supply of document sheets into copying position on the platen 14 where a single exposure of only one copy set is programmed, or a plurality of exposures may be made. Following exposure one or more times, each document sheet is automatically returned to the document supply and the next document sheet, if any, is brought into the exposure position on plate 14. Document sheets returned to the supply stack may be recycled by the apparatus 12 or simply removed by the user when the copying program is completed. Since the particular document apparatus 12 is a commerical device being part of Xerox Corporation's product labeled the 9400 Duplicator, and a variation of the same is adequately described in U.S. Pat. No. 3,944,794, which is incorporated by reference herein, further description thereof will not be included herein.

Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein.

As previously described, the document apparatus 12 includes a document tray adapted for supporting a stack comprising a plurality of document sheets in numbered sequence with page one of the multi-page document on the bottom of the stack. Since the illustrated document handling apparatus is of the bottom feeder type, page one will be the first document sheet imaged, and so on.

For either the simplex or duplex modes of operation, copy sheets exiting the exit slot 50 positioned at one end of the housing for the xerographic processor 11 are directed to the finishing station 13 which comprises a sorting or collating mechanism, a stapler apparatus, and an output elevator system. After leaving the processor 11, each sheet is positioned upon a transport 90, is registered thereon and further conveyed generally along a horizontal ascending path of movement by means of a transport belt 91 which is trained around a roller 92. The belt 91 may be driven by a motor and suitable gearing and pulleys (not shown) at a speed greater than the processing speed of the processor 11 in order to add more working space between the sheets and to ensure that the final handling of copy sheets does not impede the throughput of the entire system as determined by the process speed.

At the exit slot 50, a sheet-contacting switch S-1 is positioned to be actuated as each sheet enters the transport 90 of the finishing station 13. The circuit for this switch is connected to the logic in the programmer P and serves to reset the machine clock for the finishing function so that zero time for the sheet commences when the sheet trips the switch S-1.

As shown in FIG. 1, the end of the transport 90, at the roller 92 terminates at a copy sheet loading station 93 which defines a fixed position to which copy sheets are conveyed in timed relation to their production and at which copy sheets can be directed into sorter bins, one bin at a time during successive indexing movements of the array. The belt 91 transports copy sheets into the open ends of a array of collecting bins 95 for a sorter generally indicated by the reference numeral 96. A suitable drive motor (not shown) may be operatively connected to the sheet transport belt 91 and rendered fully and continuously operated during a production run.

In the illustrated embodiment, the array 96 includes fifteen angularly disposed bins 95 arranged in a vertical stack, the number of which may be arbitrarily chosen, or selected for some specific relationship, such as, the number of exposures per document sheet while the same is on the platen 14 or in accordance with the number of copy sheets in the total paper path for the processor 11. The array 96 is mounted for bi-directional vertical movement within a suitable supporting fixed frame and, as shown in full lines in FIG. 1, the array is positioned in its normal standby position.

As will be described hereinafter, a set binding apparatus in the form of a stapler apparatus is arranged for activation on the same side of the array 96 from the side whereat sheets are loaded into the bins. This apparatus includes means to remove or unload completed sets of collated copy sheets from each bin and to effect single or dual stapling along an edge of the set if so programmed or no stapling at all, and finally to position the stapled or unstapled sets on an elevator mechanism. In order to permit loading of copy sheets for collation thereof and complete removal of the sets from all of the bins 95 in the array 96, the array is arranged for indexing in either vertical direction one bin at a time to permit loading of copy sheets and unloading of the sets from the bins.

In the normal operating sets mode, the sorter/finishing arrangement handles a block or number of sets at a time equal to the number of bins in the array 96 when a number of copy sets to be reproduced is greater than the number of bins 95. If, however, the number of exposures of a document sheet is less than the number of bins, then the block of sets should equal the number of exposures per document sheet before the same is removed from the platen 14 and the next succeeding document sheet is fed for its own exposures. The system will continue to sort and automatically unload in blocks of sets until the programmed number of sets is completed. In producing fifteen copy sets at a time, there are fifteen bins 95 in the array 102.

The bin array 96 is indexed vertically in either direction by a drive screw 100 connected to the shaft of a servo motor M-1 which is mounted to the base of the frame for the machine. These movements of the array are effected by a threaded ball member 101 secured to the frame for the array and through which the screw 100 is threadedly related. Rotation of the screw (which is fixed against axial movement) in either direction will impart corresponding up or down movement of the ball member 101 and consequently the array. Any other drive apparatus may be utilized for indexing the array, such as pulleys and cables driven by suitably arranged fluid drive systems.

After copy sheets, simplex or duplex, have been produced in the processor 11, transported by the transport 90 and collated in the bin array 96 during the indexing movements of the array in either direction, while the system is in either the sets mode or the stacks mode, the collected sets are now in condition to be further processed by a finishing apparatus generally indicated by the reference number 105. Actually, as will be discussed below, during the last series of indexing movement of the bin array whether it is moving to either of its extreme positions, copy sets removal for the finishing action may take place simultaneously with collection of copy sheets.

The finishing apparatus 105 comprises three subassemblies each of which is programmed to operate in timed sequence with each other, with the system logic and programmer P, to be timed relative to the number of sets and copy sheets per set which were previously pre-programmed by an operator, and with the document sheet actuation of the apparatus 12. As shown in FIG. 1, the finishing apparatus comprises a set transport 107, individually-operable, dual stapler apparatus 109, and an elevator 110.

The set transport 107 is utilized to unload sets or stacks of copy sheets automatically from the bins as the same move vertically in either direction, depending upon whether there is an odd or even number of copy sheets per set, and in the finishing sequence. The set transport includes copy set clamping jaws 112 pivotally mounted at the lower end of a pivotal arm 113 mounted for limited pivotal movement in both directions on a pivot pin 114 wherein the jaws 112 are adapted for cyclic swinging action in pendulous motion. Clamping of the jaws 112 may be achieved by any suitable device such as a solenoid, or fluid actuating system (not shown) acting in timed relationship with the other events during a production run. A link member 115 connected to the clamping jaw 112 at one end and pivotally mounted on the frame of the machine serves to control positioning of the jaws so that the same may enter each bin 95 at the proper angle and to enter the stapler heads of the apparatus 109 also at the proper angle.

The stapler apparatus 109 provides a stapling function either with a single staple or with two staples, both being adapted to be applied at various positions along a long edge of a set or stack of copy sheets. Stapling is achieved by way of two identical mechanisms, each of which provides the function of set clamping, staple driving, and staple clinching. Preferably, the apparatus utilizes two commercial type stapler heads 116, such as the Bostitch staple head indicated as the 62-E manufactured by the Bostitch Division of Textron Corporation of Providence, R.I. The kicker mechanism (not shown) is utilized to push or kick stapled sets from the stapler apparatus 109 and permit dropping of the set onto the elevator 110. The operation of the kicker mechanism can be timed for actuation by means of the programmer P so as to be activated in timed sequence immediately after staple clinching and jaw opening.

The elevator 110 is utilized to collect into a pile the stapled or unstapled sets or stacks of copy sheets for delivery to the operator. The elevator comprises a tray assembly 117 mounted for vertical movement in either direction by a suitable drive mechanism, including a motion drive M-2. Elevator height of piled sets or stacks is controlled by an optical sensor SR-1 which "looks" across the stack and effects the energization of the elevator motor drive M-2 and lowering of the tray 117 until the pile is below the sensor. A second sensor (not shown) may be positioned to sense the lowermost position of the elevator tray 117 whereat the tray is considered at full capacity.

Each of the bins 95 is provided with an end wall 130 against which copy sheets are held in the bins during collection and which serve to register the sheets prior to stapling. All of the bins may be provided with scuffers for corner registration with the walls 130 defining one of the edges of the corner, or utilize joggers for the same purpose. The jaws 112 enter each of the bins by way of a suitable cutout formed on the bottom support plate of each bin and clamp the adjacent edge of a copy set. After clamping, the jaws are swung away from the bin being unloaded and pivoted to bring the clamped edge into stapling position relative to the apparatus 109.

Figure 2:
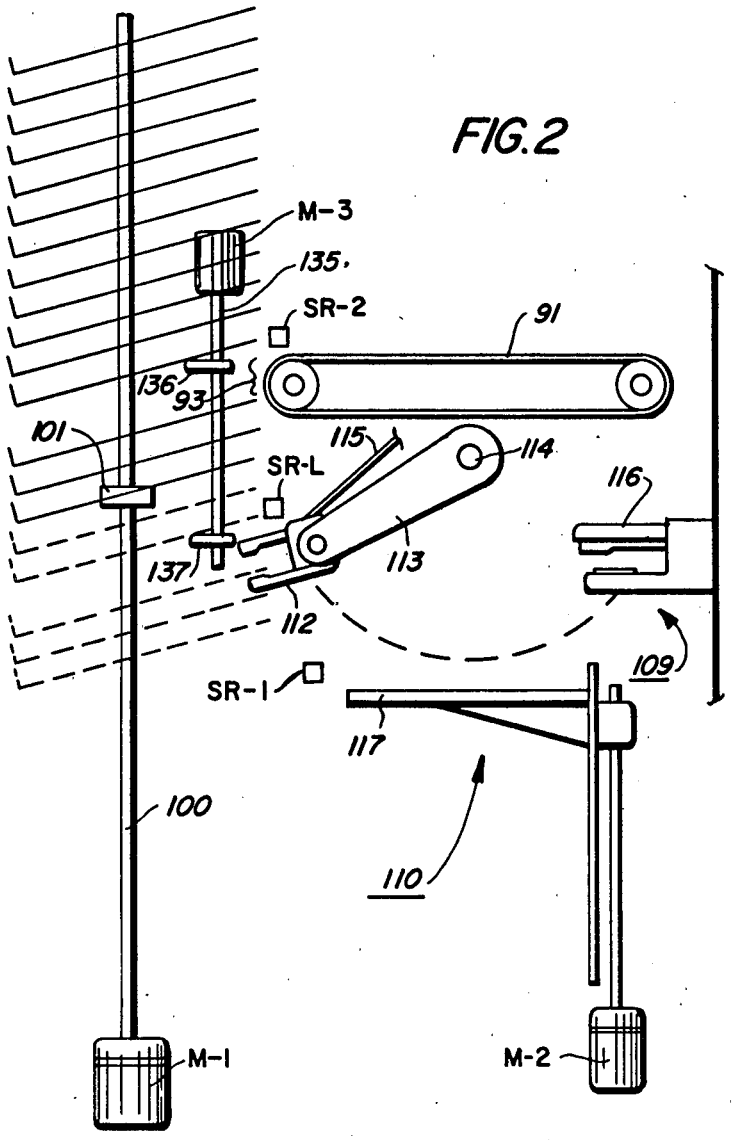
FIG. 2 is a partial, enlarged schematic illustration of the finishing apparatus.
Figure 3A:
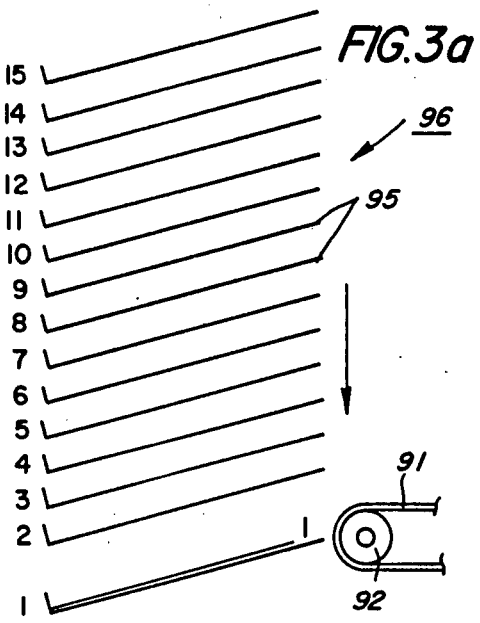
Figure 3B:
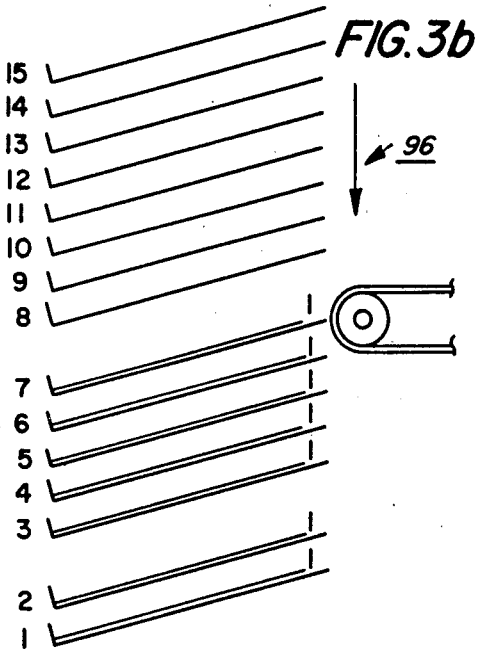
Figure 3C:
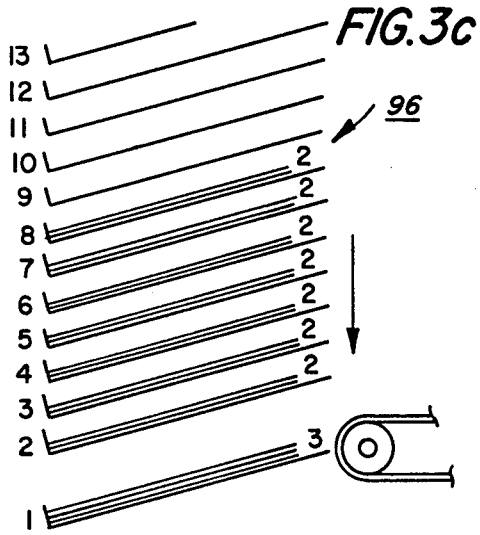
Figure 3D:
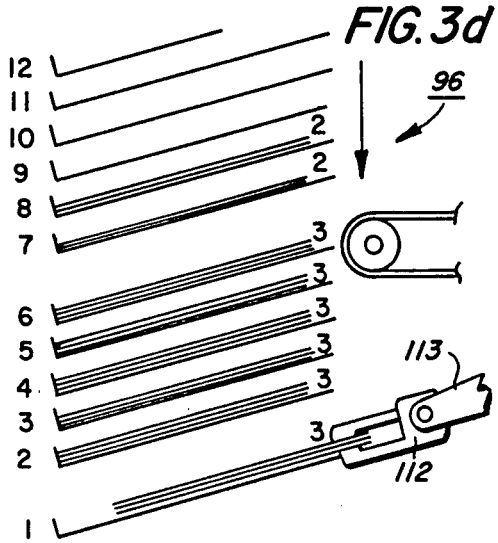

As shown in FIGS. 1 and 2, it will be noted that spacing between the bottom support walls for the bins is relatively small thereby permitting many bins to be utilized in an array which is adapted for indexing between its upper and lower extremes within relatively small confines. So that many bins may be utilized, each of the bins 95 are supported on the frame for the array 96 so that each may be spread from the bin below the same a greater distance than the normal spacing between two bins. This spreading occurs at two positions during indexing of the array in either direction: one position being opposite the loading station 93 for the conveyor 91 in order to increase the capacity of each bin while minimizing the possibility of sheets coming into contact with structure of the array, and the other position opposite the unloading station to permit unobstructed movement of the jaws 112 into each bin. Such spreading of the bins may be accomplished by means of a threaded member 135 working in conjunction with an upper cam 136 and a lower cam 137 arranged to be effective to spread adjacent bins apart as the same are indexed in their vicinity. As shown in FIG. 2, the cams 136, 137 are arranged on the member 135 so that the bins which are acted upon in this manner are five bin positions apart. A suitable motor drive M-3 arranged for imparting indexing drive movement to the cams 136, 137 is operatively associated with the member 135.

For ease of understanding later description, the bins are numbered consecutively from one to fifteen starting at the lowest bin with bin numbered fifteen at the top of the array. For each page of the copy sets being collated, the array is indexed, and, after the last sheet or page of each set and, during indexing in either the downward or upward direction, the jaws 112 sequentially unloads copy sets after the last copy sheet is loaded. A suitable sensor SR-2 may be positioned adjacent the loading station 93 to indicate to the system logic that this action has occurred. As the array indexes, for the unloading of completed copy sets, the set transport 107 unloads a set from the array at the rate of movement of one copy sheet through the transport 91, that is, indexing for unloading sets sequentially from each bin occurs while one bin is being loaded with copy sheets. When the proper number of copy sheets have been loaded for the particular block of copy sets being unloaded, copy sheets from the next block of copy sets being produced will begin being collected so that there is no losses of pitches during the production run.

In FIGS. 3(*a*)-(*d*), there is shown sequences of collating and finishing events for a document having three document sheets. In these illustrations, the vertical column of numbers one to fifteen at the left of each sequence indicate the bin number and the right hand vertical column of numbers indicate the last copy of the document sheet being collected.

In our example, it will be assumed that a document to be copied has three document sheets and that seven copy sets are programmed in the programmer P to be produced. The array 96 is in its uppermost position as shown in FIGS. 1 and 3 (*a*), with the latter figure showing page 1 in bin numbered one preparatory to the array indexing downwardly. The first page of each copy set have been loaded into the array 96 as the same indexed downwardly from the position of FIG. 3(*a*) to the position of FIG. 3(*b*).

After page 1 has been loaded for the seven copy sets programmed in the programmer P, the array 96 indexes upwardly to receive page 2. At the end of this sequence, the array indexes downwardly again to receive the third or last page of the copy sets as shown in FIG. 3(*c*). When the bin numbered six is moved into position to receive the last page, bin numbered one is moved into the position opposite the jaws 112 of the set transport to be unloaded thereby. The next indexing action will move the seventh bin downwardly to receive the last page of the programmed copy sets and will correspondingly move the second bin into position to be unloaded. As the array 96 continues to be indexed downwardly, unloading of all the remaining bins, is accomplished. The logic in the programmer P is arranged to convey the paper of the copy sets in this manner and to unload the bins as the array indexes upwardly and downwardly. The switch S-1 in cooperation with the programmer clock and the operator preset reproduction run program will determine when the last sheets have arrived so as to control the next indexing activity. Since the programmed number of paper in the copy sets was an odd number, production would terminate with the array in a lower position and the logic will effect the return of the array to its standby uppermost position. Since only seven copy sets had been programmed, a number somewhat less than the number of exposures made for each document sheet as the same is placed upon the platen 14 by the automatic document handler 12 for the production of copy sets in blocks of fifteen, then only a portion of the array 96 is utilized. If more than fifteen copy sets were programmed for production, then the array would be utilized to collate copy sets in blocks of fifteen copy sets at a time until all copy sets have been produced.

FIG. 4 is a block diagram of a control arrangement for the reproduction system in FIG. 1. The programmer P is operatively connected to four remotes: (1) the processor 11 for controlling the xerographic processing, copy sheet movement, timing and monitoring and all other parameters in the processor; (2) the input station comprising the flash illumination system circuitry; (3) the automatic document handling apparatus 12; and (4) the finishing station 13.

The finishing station 13 includes three drives, one of which is operatively connected by way of relays or reediac to the elevator motor M-2. Another driver is operatively connected to a servo controller which, in turn, is connected to two power amplifiers and associated circuitry. The third driver is operatively connected to the drive M-3 to control and operate bin spacings. One of the power amplifiers serves to energize and operate the sorter array index motor M-1, while the other amplifier serves to energize and operate the set transport drive. One of the power amplifiers also is operatively connected to the staple drive system, the stapler clamping system and the stapler clinching system.

From the foregoing it will be apparent that an electrostatographic system with finishing station has been described which will produce stapled collated sets and unstapled sets or stacks at a high production rate without loss of throughput, at a rate in accordance with the full processing speed of the copy processing machine and with a minimum of wear and fatigue of the moving parts.

While the invention has been described with reference to the structure disclosed, it is not confined to the details set forth but is intended to cover such modifications or changes which may come within the scope of the following claims.

I claim:

1. In a reproduction system having a document handling apparatus adapted to transport individual document sheets from a supply stack to an exposure platen of a reproduction processor and effecting multiple exposure of each of the document sheets before returning a sheet to the supply stack, wherein the processor produces copy sheets of the exposed document sheets, the combination of:

a sorter array having a plurality of bins arranged to receive the copy sheet output from the processor at a fixed receiving station and to collate the same, a finishing apparatus adapted to receive collated sets of copy sheets of a set of document sheets when activated and to bind the same, means for producing indexing movement of said array of bins in a copy sheet receive mode in timed relation with the activation of said finishing apparatus, and a set transport mechanism having a member pivotally mounted at one end and a gripping device at the other end, said gripping device being arranged to remove each completed set of copy sheets from each bin and to transport the same to said finishing station, said set transport and said fixed receiving station being positioned on the same side of said sorter array.

2. In a reproduction system having a processor for reproducing information to be copied on copy sheets and means for producing the information in the form of an individual light image for each copy sheet, each light image being produced a predetermined number of times in succession before a different succeeding light image is produced the same predetermined number of times, the improvement including:

an array of sheet collecting bins arranged for vertical movement relative to a copy loading position to receive copy sheets and to collate the same into sets of copies of different images, a finishing apparatus arranged to receive the collated sets of copy sheets from the collecting bins of said array, a set transport mechanism arranged to receive sequentially the collated sets from each of the bins in said array at a fixed unloading position and to transport the same to said finishing apparatus for a binding operation, said set transport means including a pivotal member having means for gripping each set at said unloading position while at one pivoted condition of said member and to transport the copy set to said finishing apparatus at another pivoted condition.

* * * * *